US011367389B2

(12) United States Patent
Xu

(10) Patent No.: US 11,367,389 B2
(45) Date of Patent: Jun. 21, 2022

(54) PIXEL CIRCUIT AND METHOD FOR DRIVING THE SAME, DISPLAY PANEL AND DISPLAY APPARATUS

(71) Applicants: CHEGDU BOE OPTOELECTRONICS TECHNOLOGY CO., LTD., Chengdu (CN); BOE TECHNOLOGY GROUP CO., LTD., Beijing (CN)

(72) Inventor: Yingsong Xu, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 612 days.

(21) Appl. No.: 16/335,195

(22) PCT Filed: Sep. 21, 2018

(86) PCT No.: PCT/CN2018/107041
§ 371 (c)(1),
(2) Date: Mar. 20, 2019

(87) PCT Pub. No.: WO2019/105118
PCT Pub. Date: Jun. 6, 2019

(65) Prior Publication Data

US 2021/0366382 A1 Nov. 25, 2021

(30) Foreign Application Priority Data

Nov. 29, 2017 (CN) ..... 201711231948.8

(51) Int. Cl.
*G09G 3/3233* (2016.01)
*G09G 3/3266* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01);
(Continued)

(58) Field of Classification Search
CPC .. G09G 2/3233; G09G 2/3266; G09G 2/3291; G09G 2300/0819;
(Continued)

(56) References Cited

U.S. PATENT DOCUMENTS 9,018,947 B2 4/2015 Jin et al.
9,041,000 B2 5/2015 Jeon
(Continued)

FOREIGN PATENT DOCUMENTS

CN 103325339 * 9/2013
CN 103383837 A 11/2013
(Continued)

OTHER PUBLICATIONS

Extended European Search Report dated May 17, 2021, received for corresponding European Application No. 18855189.9.
(Continued)

*Primary Examiner* — Sanjiv D. Patel
(74) *Attorney, Agent, or Firm* — Kinney & Lange, P.A.

(57) ABSTRACT

The embodiments of the present disclosure disclose a pixel circuit and a method for driving the same, a display panel and a display apparatus. The pixel circuit includes: a driving sub-circuit configured to provide current for causing a light-emitting element to emit light to the light-emitting element under control of a light-emitting control signal; a reset sub-circuit having a reset signal terminal for receiving a reset signal, wherein the reset sub-circuit is connected to the driving sub-circuit and a first terminal of the light-emitting element, and is configured to reset the driving sub-circuit and the first terminal of the light-emitting ele-
(Continued)

ment under control of the reset signal; a data writing sub-circuit connected to the driving sub-circuit and the reset sub-circuit, and configured to write a data voltage into the driving sub-circuit under control of a first control signal; and a sensing sub-circuit configured to receive a data signal via a first signal terminal, and transmit the data signal to the data writing sub-circuit under control of a second control signal; and sense an external input, and read the sensed external input into a read signal line under control of a read control signal.

16 Claims, 10 Drawing Sheets

(52) U.S. Cl.
CPC ..... *G09G 2300/0819* (2013.01); *G09G 2300/0842* (2013.01); *G09G 2310/0278* (2013.01)

(58) Field of Classification Search
CPC .... G09G 2300/0842; G09G 3/32–3291; G06F 3/041–0488
See application file for complete search history.

(56) References Cited

U.S. PATENT DOCUMENTS

| | | | | |
|---|---|---|---|---|
| 10,262,594 | B2 | 4/2019 | Ma | |
| 10,497,323 | B2 | 12/2019 | Zhou et al. | |
| 2009/0243498 | A1 | 10/2009 | Childs et al. | |
| 2010/0045650 | A1 | 2/2010 | Fish et al. | |
| 2011/0090202 | A1 | 4/2011 | Han | |
| 2014/0139502 | A1* | 5/2014 | Han | G09G 3/3233 345/212 |
| 2014/0146029 | A1 | 5/2014 | Hong et al. | |
| 2014/0332764 | A1 | 11/2014 | Bang et al. | |
| 2015/0193045 | A1 | 7/2015 | Zhou et al. | |
| 2016/0132171 | A1 | 5/2016 | Hu | |
| 2016/0274692 | A1 | 9/2016 | Yang | |
| 2016/0274719 | A1 | 9/2016 | Yang et al. | |
| 2016/0365035 | A1 | 12/2016 | Park | |
| 2017/0061875 | A1 | 3/2017 | Cho et al. | |
| 2017/0103706 | A1 | 4/2017 | Yang et al. | |
| 2017/0162121 | A1* | 6/2017 | Yang | G09G 3/3233 |
| 2017/0269747 | A1 | 9/2017 | Hu | |

FOREIGN PATENT DOCUMENTS

| | | | |
|---|---|---|---|
| CN | 203311812 | U | 11/2013 |
| CN | 203502926 | U | 3/2014 |
| CN | 104091562 | A | 10/2014 |
| CN | 104112120 | A | 10/2014 |
| CN | 203895093 | U | 10/2014 |
| CN | 104217677 | A | 12/2014 |
| CN | 104299571 | A | 1/2015 |
| CN | 104778923 | A | 7/2015 |
| CN | 105118438 | A | 12/2015 |
| CN | 105427803 | A | 3/2016 |
| CN | 205122154 | U | 3/2016 |
| CN | 106531076 | A | 3/2017 |
| CN | 107358917 | A | 11/2017 |
| EP | 3163559 | A1 | 5/2017 |
| WO | 2014201755 | A1 | 12/2014 |

OTHER PUBLICATIONS

International Search Report and English Translation of Box V of the Written Opinion dated Nov. 28, 2018, received for corresponding PCT Application No. PCT/CN2018/107041.
First Chinese Office Action dated Mar. 10, 2020, received for corresponding Chinese Application No. 201711231948.8, 15 pages.

* cited by examiner

PIXEL CIRCUIT AND METHOD FOR DRIVING THE SAME, DISPLAY PANEL AND DISPLAY APPARATUS

CROSS-REFERENCE TO RELATED APPLICATION(S)

This application claims priority to the Chinese Patent Application No. 201711231948.8, filed on Nov. 19, 2017, which is incorporated herein by reference in its entirety.

TECHNICAL FIELD

The present disclosure relates to the field of display, and more particularly, to a pixel circuit and a method for driving the same, a display panel and a display apparatus.

BACKGROUND

In a pixel driving circuit of, for example, an Active Matrix Organic Light-emitting Diode (AMOLED) display apparatus, an Excimer Laser Annealing (ELA) and doping process used in actual production for manufacturing TFTs (Thin Film Transistors) in an AMOLED display screen cannot guarantee good uniformity of the TFTs, and thus there is a phenomenon of a deviation of a threshold voltage Vth of driving transistors. For example, for basic 2T1C (two thin film transistors and one capacitor) pixel circuits in the AMOLED display screen, when the same data signal is written therein, various pixels have non-uniform brightness due to different values of Vth in a current formula of light-emitting elements. In addition, it is desirable to integrate biometric recognition functions such as fingerprint recognition, pressure sensing, touch technology, etc. into an OLED panel without the aid of an external sensor.

SUMMARY

Embodiments of the present disclosure provide a pixel circuit and a method for driving the same, a display panel and a display apparatus.

According to an aspect of the embodiments of the present disclosure, there is provided a pixel circuit, comprising:

a light-emitting element;

a driving sub-circuit having a light-emitting control terminal for receiving a light-emitting control signal and an output terminal connected to a first terminal of the light-emitting element, wherein the driving sub-circuit is configured to provide current for causing the light-emitting element to emit light to the light-emitting element under control of a light-emitting control signal;

a reset sub-circuit having a reset signal terminal for receiving a reset signal, wherein the reset sub-circuit is connected to the driving sub-circuit and the first terminal of the light-emitting element, and is configured to reset the driving sub-circuit and the first terminal of the light-emitting element under control of the reset signal;

a data writing sub-circuit having a first control signal terminal for receiving a first control signal, wherein the data writing sub-circuit is connected to the driving sub-circuit and the reset sub-circuit, and is configured to write a data voltage into the driving sub-circuit under control of a first control signal; and a sensing sub-circuit having a first signal terminal connected to a data signal line, a second signal terminal connected to a read signal line, and a second control signal terminal for receiving a second control signal, wherein the sensing sub-circuit is connected to the data writing sub-circuit, wherein the sensing sub-circuit is configured to receive a data signal via the first signal terminal, and transmit the data signal to the data writing sub-circuit under control of the second control signal; and sense an external input, and read the sensed external input into the read signal line under control of a read control signal.

In an example, the sensing sub-circuit comprises:

a sensing element, wherein a first terminal of the sensing element is connected to a first voltage terminal, and a second terminal of the sensing element is connected to a first node; and a first transistor, wherein a gate of the first transistor is connected to the second control signal terminal, a first electrode of the first transistor is connected to the data signal line, and a second electrode of the first transistor is connected to the first node, wherein the first node is directly connected to the read signal line.

In an example, the sensing sub-circuit further comprises a read control signal terminal for receiving the read control signal.

In an example, the sensing sub-circuit comprises:

a sensing element, wherein a first terminal of the sensing element is connected to the first voltage terminal, and a second terminal of the sensing element is connected to the first node;

a first transistor, wherein a gate of the first transistor is connected to the second control signal terminal, a first electrode of the first transistor is connected to the data signal line, and a second electrode of the first transistor is connected to the first node; and a second transistor, wherein a gate of the second transistor is connected to the read control signal terminal, a first electrode of the second transistor is connected to the read signal line, and a second electrode of the second transistor is connected to the first node.

In an example, the data writing sub-circuit comprises:

a third transistor, wherein a gate of the third transistor is connected to the first control signal terminal, a first electrode of the third transistor is connected to a first node, and a second electrode of the third transistor is connected to the driving sub-circuit; and a fourth transistor, wherein a gate of the fourth transistor is connected to the first control signal terminal, a first electrode of the fourth transistor is connected to a second node, and a second electrode of the fourth transistor is connected to the driving sub-circuit.

In an example, the driving sub-circuit comprises a fifth transistor, a storage capacitor, a driving transistor, and a sixth transistor, wherein a gate of the fifth transistor is connected to a light-emitting control signal terminal, a first electrode of the fifth transistor is connected to a first voltage terminal, and a second electrode of the fifth transistor is connected to a source of the driving transistor; a first terminal of the storage capacitor is connected to the first voltage terminal, and a second terminal of the storage capacitor is connected to a gate of the driving transistor; a drain of the driving transistor is connected to a first electrode of the sixth transistor; and a gate of the sixth transistor is connected to the light-emitting control signal terminal, and a second electrode of the sixth transistor is connected to the first terminal of the light-emitting element.

In an example, the reset sub-circuit comprises a seventh transistor and an eighth transistor, wherein a gate of the seventh transistor is connected to the reset signal terminal, a first electrode of the seventh transistor is connected to a second voltage terminal, and a second electrode of the seventh transistor is connected to the first electrode of the fourth transistor; and a gate of the eighth transistor is connected to the reset signal terminal, a first electrode of the eighth transistor is connected to the second voltage terminal, and a second electrode of the eighth transistor is connected to the first terminal of the light-emitting element; and a second terminal of the light-emitting element is grounded.

In an example, the sensing element comprises at least one of a pressure sensor, a photosensor, and a temperature sensor.

According to another aspect of the embodiments of the present disclosure, there is provided a display panel, comprising:

a plurality of scanning signal lines;

a plurality of data signal lines disposed to intersect the plurality of scanning signal lines in vertical and horizontal directions; and a plurality of pixel units disposed at intersections of the data signal lines and the scanning signal lines, wherein at least one of the plurality of pixel units comprises the pixel circuit according to the embodiments of the present disclosure.

In an example, at least one of the plurality of scanning signal lines is used as the read signal line.

According to yet another aspect of the embodiments of the present disclosure, there is provided a display apparatus, comprising the display panel according to the embodiments of the present disclosure.

According to a further aspect of the embodiments of the present disclosure, there is provided a method for driving the pixel circuit according to the embodiments of the present disclosure, comprising:

in a first time period, resetting the driving sub-circuit;

in a second time period, writing, by the writing sub-circuit, a data voltage into the driving sub-circuit;

in a third time period, resetting the sensing sub-circuit; and in a fourth time period, sensing, by the sensing sub-circuit, an external input.

In an example, the sensing sub-circuit reads a sensing voltage sensed by the sensing element into the read signal line in at least one of the first time period and the fourth time period under control of the read control signal.

In an example, in the first time period, the first transistor is turned off, and a voltage at the first node is transmitted to the read signal line under control of the read control signal;

in the second time period, the voltage on the data signal line is a data voltage, the first transistor is turned on, and the first node is set to the data voltage;

in the third time period, the voltage on the data signal line is a reference voltage, the first transistor is turned on, and the first node is set to the reference voltage; and in the fourth time period, the first transistor is turned off, and the first node is set to a sum of the reference voltage and the sensing voltage.

In an example, the reset signal is used as the read control signal.

BRIEF DESCRIPTION OF THE ACCOMPANYING DRAWINGS

In order to more clearly illustrate the technical solutions in the embodiments of the present disclosure or the related art, the accompanying drawings to be used in the description of the embodiments will be briefly described below. Obviously, the accompanying drawings in the following description are only some embodiments of the present disclosure, and other accompanying drawings can be obtained by those of ordinary skill in the art according to these accompanying drawings without any creative work. In the accompanying drawings, FIG. 1 illustrates a schematic block diagram of a pixel circuit according to an embodiment of the present disclosure;

DETAILED DESCRIPTION

Figure 1:
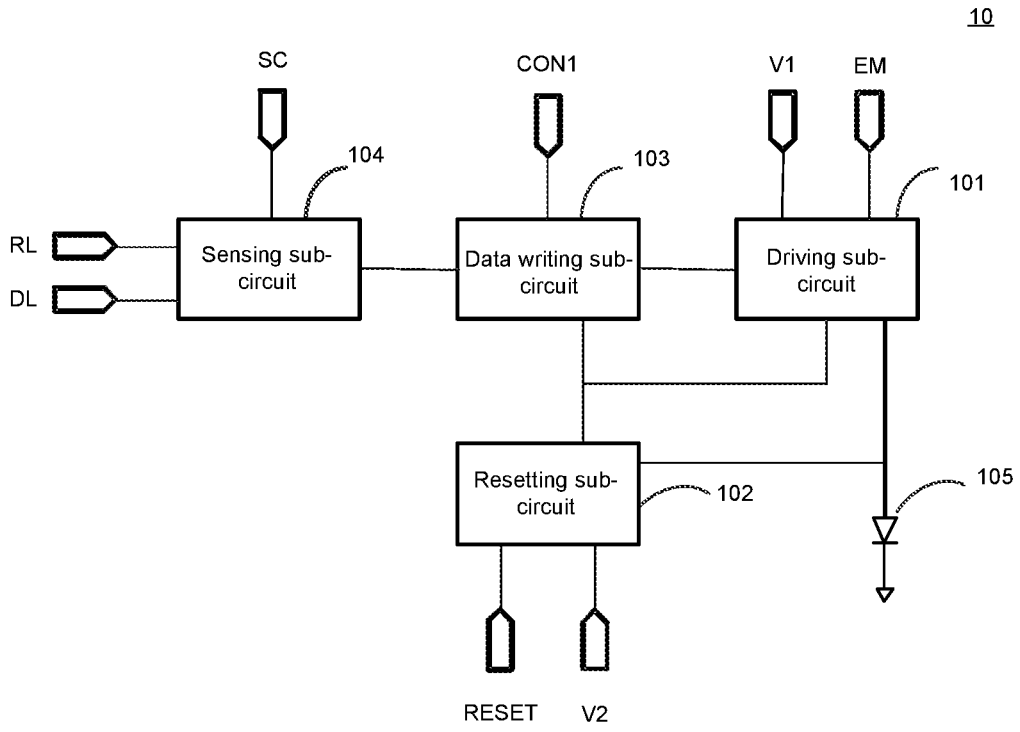

In order to make the purposes, technical solutions and advantages of the embodiments of the present disclosure more clear, the technical solutions in the embodiments of the present disclosure will be clearly and completely described below in conjunction with the accompanying drawings in the embodiments of the present disclosure. Obviously, the embodiments described are a part of the embodiments of the present disclosure instead of all the embodiments. All other embodiments obtained by those of ordinary skill in the art based on the described embodiments of the present disclosure without contributing any creative work are within the protection scope of the present disclosure. It should be illustrated that throughout the accompanying drawings, the same elements are represented by the same or similar reference signs. In the following description, some specific embodiments are for illustrative purposes only and are not to be construed as limiting the present disclosure, but merely examples of the embodiments of the present disclosure. The conventional structure or construction will be omitted when it may cause confusion with the understanding of the present disclosure. It should be illustrated that shapes and dimensions of components in the figures do not reflect true sizes and proportions, but only illustrate contents of the embodiments of the present disclosure.

Unless otherwise defined, technical terms or scientific terms used in the embodiments of the present disclosure should be of ordinary meanings to those skilled in the art. "First", "second" and similar words used in the embodiments of the present disclosure do not represent any order, quantity or importance, but are merely used to distinguish between different constituent parts.

Furthermore, in the description of the embodiments of the present disclosure, the term "connected" or "connected to" may mean that two components are directly connected, or that two components are connected via one or more other components. In addition, the two components can be connected or coupled by wire or wirelessly.

In addition, in the description of the embodiments of the present disclosure, the terms "first level" and "second level" are only used to distinguish magnitudes of the two levels from each other. For example, the following description is made by taking the "first level" being a low level and the "second level" being a high level as an example.

The transistors used in the embodiments of the present disclosure may each be a thin film transistor or a field effect transistor or other devices having the same characteristics. The transistor used in the embodiments of the present disclosure may primarily be a switch transistor depending on a function thereof in a circuit. Since a source and a drain of the thin film transistor used herein are symmetrical, the source and the drain thereof may be interchanged. In the embodiments of the present disclosure, one of the source and the drain is referred to as a first electrode, and the other of the source and the drain is referred to as a second electrode. In the following examples, the description is made by taking a P-type thin film transistor as an example.

The embodiments of the present disclosure provide a pixel circuit. FIG. 1 illustrates a schematic block diagram of a pixel circuit according to an embodiment of the present disclosure.

As shown in FIG. 1, the pixel circuit 10 according to the embodiment of the present disclosure may comprise a light-emitting element 105. For example, the light-emitting element 105 may be a current driven light-emitting element such as an AMOLED. The pixel circuit 10 further comprises a driving sub-circuit 101 having a light-emitting control terminal EM for receiving a light-emitting control signal Em and an output terminal connected to a first terminal of the light-emitting element 105. The driving sub-circuit 101 is configured to provide current for causing the light-emitting element to emit light to the light-emitting element 105 under control of a light-emitting control signal. The pixel circuit 10 further comprises a reset sub-circuit 102. The reset sub-circuit 102 has a reset signal terminal RESET for receiving a reset signal Reset, and is connected to the driving sub-circuit 101 and the first terminal of the light-emitting element 105. The reset sub-circuit 102 is configured to reset the driving sub-circuit 101 and the first terminal of the light-emitting element 105 under control of the reset signal Reset. The pixel circuit 10 further comprises a data writing sub-circuit 103 having a first control signal terminal CON1 for receiving a first control signal Con1. The data writing sub-circuit 103 is connected to the driving sub-circuit 101 and is configured to write a data voltage signal Vdata into the driving sub-circuit 101 under control of the first control signal Con1. The pixel circuit 10 further comprises a sensing sub-circuit 104. In one embodiment, the reset sub-circuit 102 is connected to a common terminal between the driving sub-circuit 101 and the data writing sub-circuit 103. The sensing sub-circuit 104 has a first signal terminal connected to a data signal line DL, a second signal terminal connected to a read signal line RL, and a second control signal terminal CON2 for receiving a second control signal Con2. The sensing sub-circuit 104 is connected to the data writing sub-circuit 103, and is configured to receive the data voltage signal via the first signal terminal, and transmit the data voltage signal Vdata to the data writing sub-circuit 103 under control of the second control signal Con2; and sense an external input, and read the sensed external input into the read signal line RL via the second signal terminal under control of a read control signal Sc.

According to an embodiment of the present disclosure, one or more of scanning signal lines of a display panel may be used as read signal line(s) RL. In this case, a scanning signal line connected to the pixel circuit according to the embodiment of the present disclosure is used only for transmitting the sensed external input read at a first node N1. A specific reading frequency (or sampling frequency) may be controlled by adjusting a frequency of the read control signal Sc. For example, the read control signal Sc may be generated by a timing controller Integrated Circuit (IC) of a display apparatus according to practical requirements.

Figure 2A:
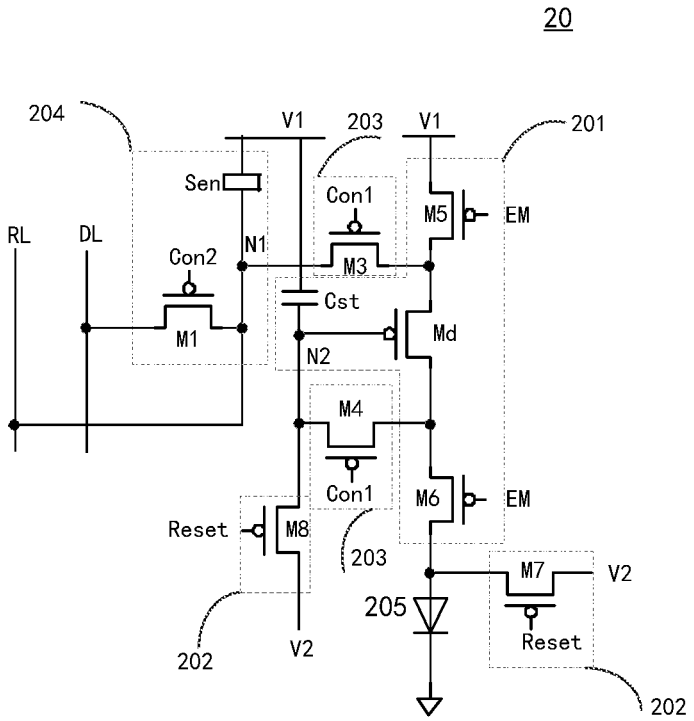
FIG. 2A illustrates a schematic circuit diagram of a pixel circuit according to an embodiment of the present disclosure.

FIG. 2A illustrates a schematic circuit diagram of a pixel circuit 20 according to an embodiment of the present disclosure. Next, a circuit structure of the pixel circuit according to the embodiment of the present disclosure will be described in detail with reference to FIG. 2A. As shown in FIG. 2A, the pixel circuit 20 according to the embodiment of the present disclosure comprises a driving sub-circuit 201, a reset sub-circuit 202, a data writing sub-circuit 203, and a sensing sub-circuit 204.

The sensing sub-circuit 204 comprises a sensing element Sen, wherein a first terminal of the sensing element is connected to a first voltage terminal V1, and a second terminal of the sensing element is connected to the first node N1; and a first transistor M1, wherein a gate of the first transistor M1 is connected to the second control signal terminal CON2, a first electrode of the first transistor M1 is connected to the data signal line DL, and a second electrode of the first transistor M1 is connected to a second terminal of the sensing element Sen, that is, the first node N1. As shown in FIG. 2A, the second terminal of the sensing element Sen is directly connected to the read signal line RL via the first node N1. It can be understood by those skilled in the art that the first voltage terminal V1 according to the embodiment of the present disclosure may receive a voltage signal Vdd. The sensing element Sen may comprise at least one of a pressure sensor, a photosensor, and a temperature sensor.

The data writing sub-circuit 203 comprises a third transistor M3, wherein a gate of the third transistor M3 is connected to the first control signal terminal CON1, a first electrode of the third transistor M3 is connected to the first node N1, and a second electrode of the third transistor M3 is connected to the driving sub-circuit 201; and a four transistor M4, wherein a gate of the fourth transistor M4 is connected to the first control signal terminal CON1, a first electrode of the third transistor M3 is connected to a second node N2, and a second electrode of the third transistor M3 is connected to the driving sub-circuit 201 via a fourth node N4.

The driving sub-circuit 201 comprises a fifth transistor M5, a storage capacitor Cst, a driving transistor Md, and a sixth transistor M6. A gate of the fifth transistor M5 is connected to a light-emitting control signal terminal EM, a first electrode of the fifth transistor M5 is connected to the first voltage terminal V1, and a second electrode of the fifth transistor M5 is connected to a source of the driving transistor Md via a third node N3. A first terminal of the storage capacitor Cst is connected to the first voltage terminal V1, and a second terminal of the storage capacitor Cst is connected to a gate of the driving transistor Md. A drain of the driving transistor Md is connected to a first electrode of the sixth transistor M6 via the fourth node N4. A gate of the sixth transistor is connected to the light-emitting control signal terminal EM, and a second electrode of the sixth transistor is connected to a first terminal of the light-emitting element 205.

The reset sub-circuit 202 comprises a seventh transistor M7 and an eighth transistor M8. A gate of the seventh transistor M7 is connected to the reset signal terminal RESET, a first electrode of the seventh transistor M7 is connected to a second voltage terminal V2, and a second electrode of the seventh transistor M7 is connected to the first electrode of the fourth transistor M4. A gate of the eighth transistor M8 is connected to the reset signal terminal RESET, a first electrode of the eighth transistor M8 is connected to the second voltage terminal V2, and a second electrode of the eighth transistor M8 is connected to the first terminal of the light-emitting element 205. For example, a second terminal of the light-emitting element 205 may be grounded. It can be understood by those skilled in the art that the second voltage terminal V2 according to the embodiment of the present disclosure may receive a low level voltage signal Vinit.

According to an embodiment of the present disclosure, the driving transistor Md may be a P-type transistor.

Figure 2B:
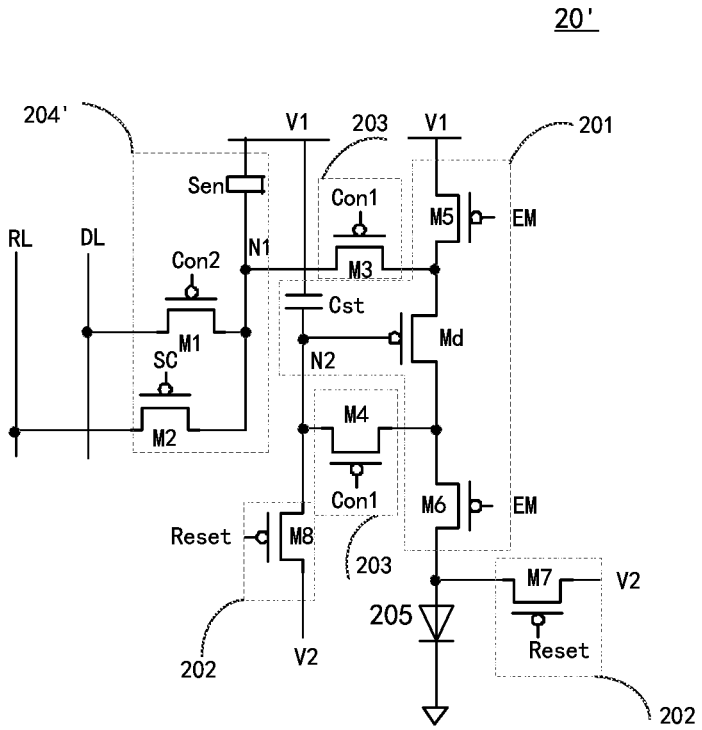
FIG. 2B illustrates a schematic circuit diagram of a pixel circuit according to another embodiment of the present disclosure.

FIG. 2B illustrates a schematic circuit diagram of a pixel circuit 20' according to an embodiment of the present disclosure. Next, a circuit structure of the pixel circuit according to the embodiment of the present disclosure will be described in detail with reference to FIG. 2B. As shown in FIG. 2B, the pixel circuit 20' according to the embodiment of the present disclosure comprises a driving sub-circuit 201, a reset sub-circuit 202, a data writing sub-circuit 203, and a sensing sub-circuit 204', wherein the driving sub-circuit 201, the reset sub-circuit 202 and data writing sub-circuit 203 have the same circuit structures as those in the embodiment shown in FIG. 2A, and will not be described here again. Unlike FIG. 2A, the sensing sub-circuit 204' in FIG. 2B may further comprise a second transistor M2, wherein a gate of the second transistor M2 is connected to a read control signal terminal SC, a first electrode of the second transistor M2 is connected to the read signal line RL, and a second electrode of the second transistor M2 is connected to the second terminal of the sensing element Sen, that is, the first node N1. In an embodiment of the present disclosure, the reset signal Reset may be used as the read control signal Sc.

Figure 3:
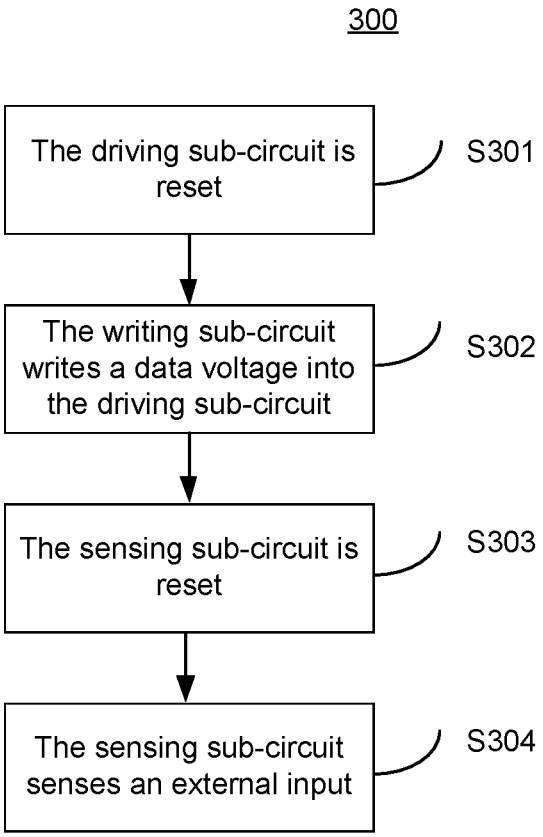
FIG. 3 illustrates a flowchart of a method for driving a pixel circuit according to an embodiment of the present disclosure.

The embodiments of the present disclosure further provide a method for driving a pixel circuit, which may be applied to the pixel circuit according to the embodiment of the present disclosure. It should be illustrated that serial numbers of various steps in the following method are only used as a representation of the steps for convenience of the description, and should not be regarded as indicating an execution order of the respective steps. This method does not need to be performed exactly in an order as shown, unless explicitly stated. FIG. 3 illustrates a flowchart of a method for driving a pixel circuit according to an embodiment of the present disclosure. As shown in FIG. 3, the method 300 for driving a pixel circuit according to the embodiment of the present disclosure may comprise the following steps for one display period.

In step S301, the driving sub-circuit is reset.

In step S302, the writing sub-circuit writes a data voltage into the driving sub-circuit.

In step S303, the sensing sub-circuit is reset.

In step S304, the sensing sub-circuit senses an external input.

Figure 4A:
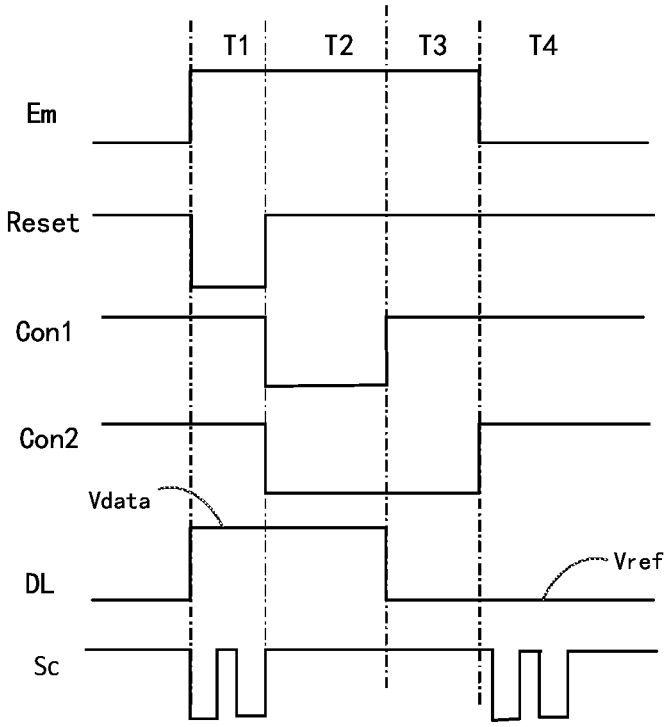
FIG. 4A illustrates an operating timing diagram of signals of the pixel circuit shown in FIG. 2A.
Figure 4B:
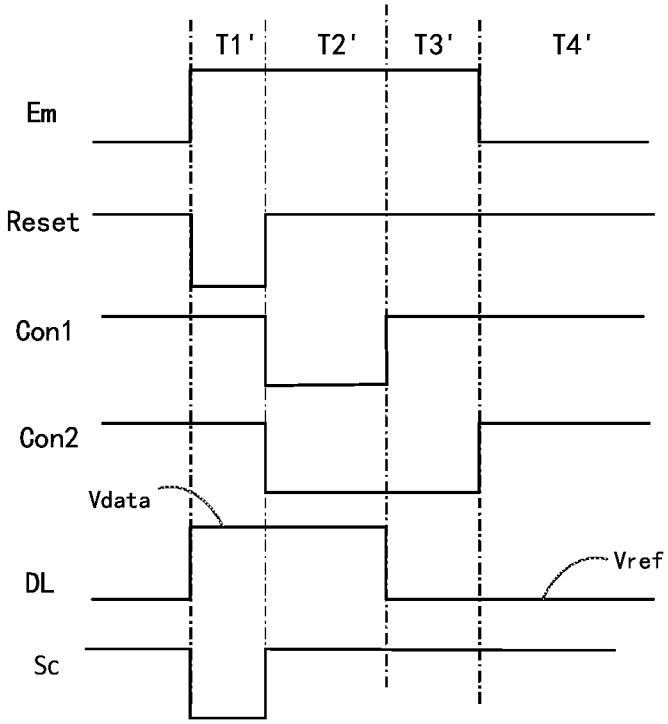
FIG. 4B illustrates an exemplary operating timing diagram of signals of the pixel circuit shown in FIG. 2B.

FIG. 4A illustrates an operating timing diagram of signals of the pixel circuit shown in FIG. 2A. FIGS. 5A to 5D illustrate schematic diagrams of principles of the pixel circuit shown in FIG. 2A in various time periods respectively. Next, an operation of the pixel circuit 20 according to the embodiment of the present disclosure as shown in, for example, FIG. 2A in one display period i will be described in detail with reference to FIGS. 2A, 3, 4A, and 5A to 5D.

Figure 5A:
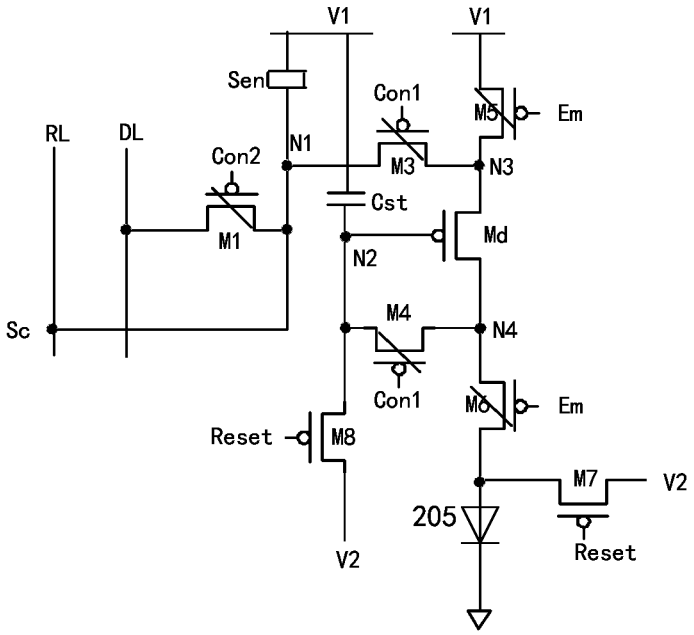
FIG. 5A illustrates a schematic diagram of a principle of the pixel circuit shown in FIG. 2A in a first time period.

In a first time period T1, as shown in FIG. 5A, the reset signal Reset is at a low level, and other signals are at a high level. The reset signal Reset is at a low level, and the seventh transistor M7 and the eighth transistor M8 are turned on. It should be illustrated that a transistor which is turned off in this time period is indicated by a diagonal line in FIG. 5A, for example, in the first time period T1, the first transistor M1, the third transistor M3, the fourth transistor M4, the fifth transistor M5, and the sixth transistor M6 are turned off. The seventh transistor M7 is turned on, and a potential at the anode of the light-emitting element becomes Vinit. The eighth transistor M8 is turned on, so that the voltage at the second node N2 becomes the low level initial voltage Vinit. Thereby, the driving transistor Md is turned on, and the potential at the anode of the light-emitting element is further reduced to Vinit rapidly, thereby causing the driving sub-circuit to be reset. In this way, brightness of the light-emitting element is rapidly reduced, and a contrast of the light-emitting element is enhanced. A voltage difference Vc across the capacitor Cst is equal to Vdd-Vinit. At the same time, the read control signal Sc may be set to an active operating level, so that a voltage value $V_{N1}$ at the first node N1 at this time is written into the read signal line RL, and is transmitted to a processing IC via the RL to analyze the voltage value $V_{N1}$ at the first node N1. Thereby, a sensing result of the sensing element Sen in a previous display period (i−1) is determined. For example, the processing IC may be a driving IC which provides a display signal, such as a gate driver. The first time period T1 may be referred to as a "driving sub-circuit reset phase."

Figure 5B:
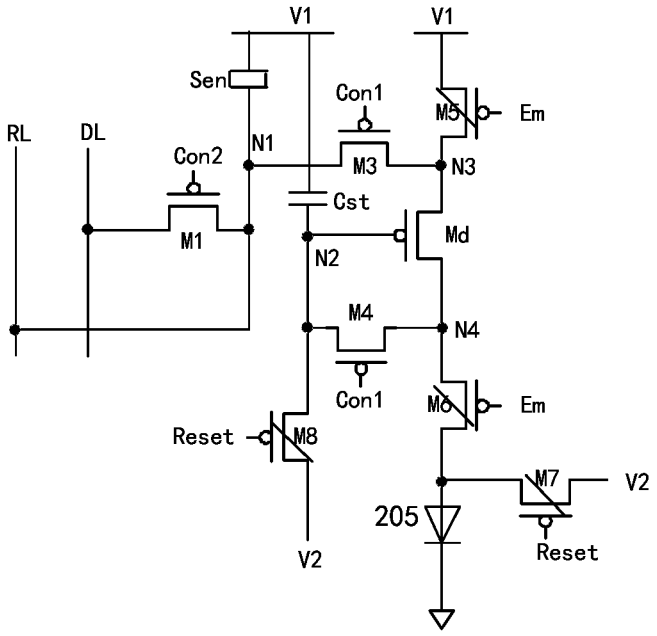
FIG. 5B illustrates a schematic diagram of a principle of the pixel circuit shown in FIG. 2A in a second time period.

In a second time period T2, as shown in FIG. 5B, the first control signal Con1 and the second control signal Con2 are at a low level, and other signals are at a high level. The first control signal Con1 is at a low level, and the third transistor M3 and the fourth transistor M4 are turned on. The second control signal Con2 is at a low level, and the first transistor M1 is turned on. Similarly, a transistor which is turned off in this time period is indicated by a diagonal line in FIG. 5B, for example, in the second time period T2, the fifth transistor M5, the sixth transistor M6, the seventh transistor M7, and the eighth transistor M8 are turned off. Since the first transistor M1 is turned on, the data voltage Vdata on the data signal line is applied to the first node N1, and thus the voltage value $V_{N1}$ at the first node N1 is equal to Vdata. The third transistor M3 is turned on, and a source voltage $V_S$ of the driving transistor Md is equal to Vdata. At this time, the voltage value $V_{N2}$ at the second terminal of the storage capacitor Cst, that is, the second node N2, is equal to Vg=Vdata+Vth, where Vg is a gate voltage of the driving transistor Md, and Vth is a threshold voltage of the driving transistor Md. The second time period T2 may be referred to as a "data writing phase."

Figure 5C:
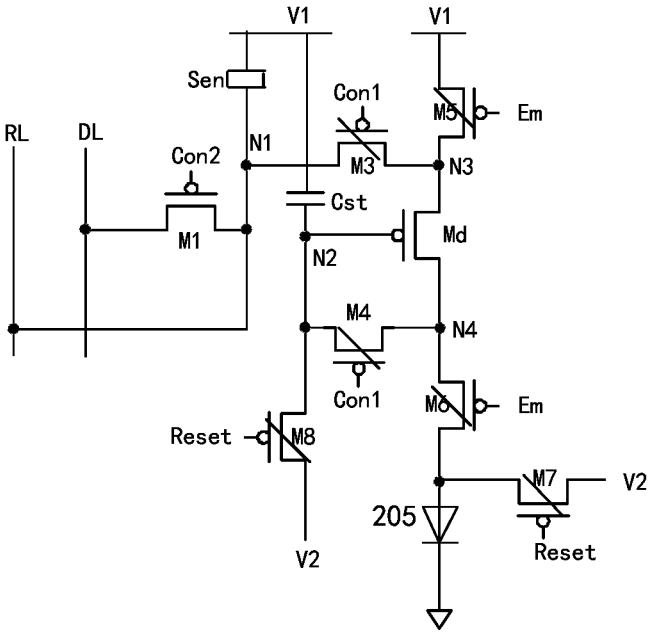
FIG. 5C illustrates a schematic diagram of a principle of the pixel circuit shown in FIG. 2A in a third time period.

In a third time period T3, as shown in FIG. 5C, the second control signal Con2 is at a low level, and other signals are at a high level. The second control signal Con2 is at a low level, and the first transistor M1 is turned on. Similarly, a transistor which is turned off in this time period is indicated by a diagonal line in FIG. 5C. In the third time period T3, the voltage on the read signal line changes from the data voltage Vdata to the reference voltage Vref, the first transistor M1 is turned on, and the reference voltage Vref on the data signal line is applied to the first node N1. Therefore, at this time, the voltage value $V_{N1}$ at the first node N1 is equal to Vref, which is equivalent to resetting the sensing sub-circuit to provide a reference potential for the sensing result of the sensing element. The third time period T3 may be referred to as a "sensing sub-circuit reset phase."

Figure 5D:
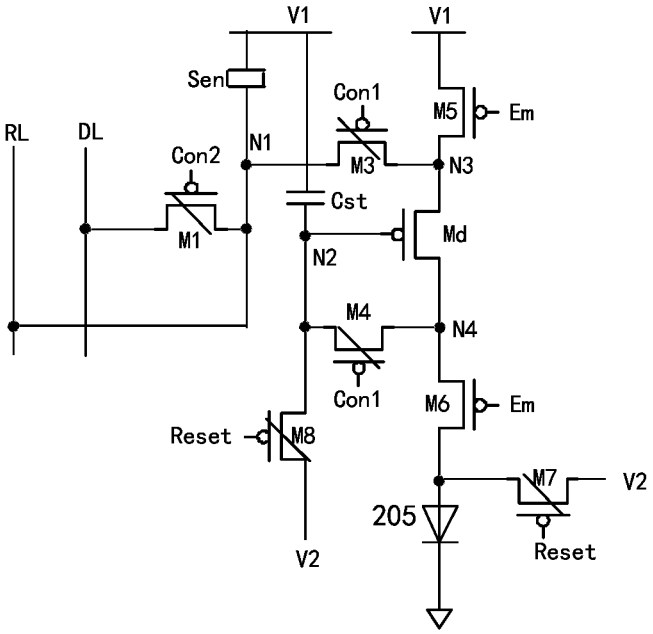
FIG. 5D illustrates a schematic diagram of a principle of the pixel circuit shown in FIG. 2A in a fourth time period.

In a fourth time period T4, as shown in FIG. 5D, the light-emitting control signal Em is at a low level, and other signals are at a high level. The light-emitting control signal Em is at a low level, the fifth transistor M5 and the sixth transistor M6 are turned on, and the light-emitting element emits light. Similarly, a transistor which is turned off in this time period is indicated by a diagonal line in FIG. 5D. The fifth transistor M5 is turned on, and the source voltage Vs of the driving transistor Md is equal to Vdd. Since the driving transistor Md is a P-type transistor, a gate-source voltage Vgs of the driving transistor Md is:

$$\begin{aligned} Vgs &= Vg - Vs \\ &= Vdata + Vth - Vdd \end{aligned}$$

Based thereon, driving current I flowing through the light-emitting element is:

$$\begin{aligned} I &= K(Vgs - Vth)^2 \qquad (1) \\ &= K(Vdata + Vth - Vdd - Vth)^2 \\ &= K(Vdata - Vdd)^2. \end{aligned}$$

where K is a current constant associated with the driving transistor Md, which is related to process parameters and geometric dimensions of the driving transistor Md. It can be seen from the above formula (1) that the driving current I for driving the light-emitting element to emit light is independent of the threshold voltage Vth of the driving transistor Md, so that a phenomenon in which various light-emitting elements have non-uniform brightness due to a difference among threshold voltages Vth of driving transistors Md in pixel circuits of various sub-pixels may be eliminated.

In the fourth time period T4, the potential $V_{N1}$ at the first node N1 is equal to Vsense+Vref, where Vsense indicates a value of an external input sensed by the sensing element Sen. The read control signal Sc may be set to an active operating level, so that the voltage value $V_{N1}$ at the first node N1 at this time is written into the read signal line RL, and is transmitted to the processing IC via the RL to analyze the voltage value $V_{N1}$ at the first node N1, so as to determine the sensing result of the sensing element Sen in the current display period i.

For example, when the sensing element Sen is a piezoelectric ceramic, in a case where touch is performed by a finger at a point corresponding to the pixel circuit or in a pixel region corresponding to the pixel circuit, the potential at the first node N1 changes (from the reference voltage Vref), and in the fourth time period T4 and/or in a first time period T1 of a next display period (i+1), the potential at the first node N1 is sampled and transmitted to a processing apparatus via the read signal line RL. The processing apparatus performs calculation to confirm the touch at the point and a pressure change at the point.

When the sensing element Sen is a capacitor, for example, a capacitor formed by SD (having a Ti/Al/Ti sandwich structure) metal and gate metal, wherein the Gate metal is generally used as a gate of the TFT, and the SD is generally in contact with a source and a drain of the TFT, in a case where touch is performed by a finger at the point, the potential at the first node N1 changes (from the reference voltage Vref), and in the fourth time period T4 and/or in the first time period T1 of the next display period (i+1), the potential at the first node N1 is sampled and transmitted to the processing apparatus via the read signal line RL. The processing apparatus performs calculation to confirm the touch at the point.

When the sensing element Sen is a photosensor, for example, a photodiode, after the sensing element is illuminated, the photodiode is turned on, so that the potential at the first node N1 becomes Vdd, or is significantly different from Vref. For example, after a finger touches a screen, the photosensor may receive light which is diffusely reflected by the finger, so as to determine the touch of the finger or a fingerprint change of the finger, and thereby feed back the change to the processing apparatus. The processing apparatus performs calculation to perform image processing such as fingerprint recognition.

When the sensing element Sen is a temperature sensor, for example, a temperature sensitive diode, after the sensing element senses a temperature change, the potential at the first node N1 changes from Vref, so as to determine a temperature change in an external environment. When the temperature becomes higher, there is a current change in the driving transistor, which results in extremely high brightness of the light-emitting element, thereby reducing the user experience and the lifetime of the OLED. Therefore, the temperature change may be sensed by the sensing element Sen, and when the sensing element Sen senses that the temperature is too high, the data voltage Vdata may be appropriately reduced by calculation, thereby obtaining a better screen display effect and extending the lifetime of the OLED.

The sensing element Sen may also be a UltraViolet (UV) sensor or other wavelength sensors. The brightness of the screen may be adjusted by sensing external illumination, so as to improve the visual effect.

Although, in the example of FIG. 4A, the read control signal Sc is at an active operating level in both the first time period T1 and the fourth time period T4, according to an embodiment of the present disclosure, the read control signal Sc may be set to be at an active operating level in at least one of the first time period and the fourth time period, so that the sensing voltage sensed by the sensing element is read by the sensing sub-circuit into the read signal line. It should be illustrated that $V_{N1}$ transmitted to the read control line RL in the first time period T1 substantially indicates the sensing result of the sensing element Sen in a previous display period (i−1), and $V_{N1}$ transmitted to the read control line RL in the fourth time period T4 substantially indicates the sensing result of the sensing element Sen in the current display period i. Further, a waveform and a frequency of the read control signal Sc in the example of FIG. 4A are merely examples, and the waveform and the frequency of the read control signal Sc may be set to other forms as long as the voltage at the first node N1 may be read into the read signal line in a predetermined time period.

FIGS. 6A to 6D illustrate schematic diagrams of principles of the pixel circuit shown in FIG. 2B in various time periods respectively. It should be illustrated that an operation of the pixel circuit 20' according to the embodiment of the present disclosure as shown in, for example, FIG. 2B in one display period i will be described in detail below with reference to FIGS. 2B, 3 and 6A to 6D. Unlike the description made with reference to FIG. 2A, the sensing sub-circuit of the pixel circuit 20' may further comprise a second transistor M2, wherein a gate of the second transistor is connected to the read control signal terminal, a first electrode of the second transistor is connected to the read signal line RL, and a second electrode of the second transistor is connected to the first node. For the sake of brevity, the same technical contents as those in the embodiments described with reference to FIGS. 2A and 5A to 5D will not be described in detail again.

In this example, the reset signal Reset may be input to the read control signal terminal SC, that is, the reset signal Reset is used as the read control signal Sc.

Figure 6A:
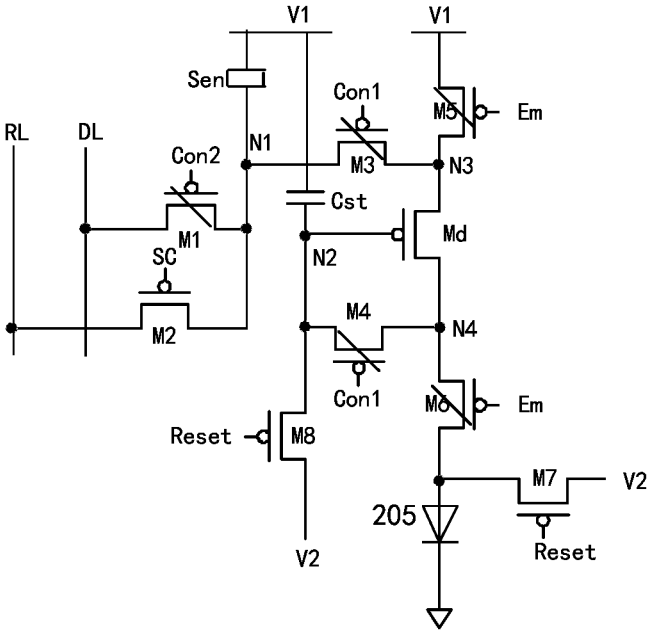
FIG. 6A illustrates a schematic diagram of a principle of the pixel circuit shown in FIG. 2B in a first time period.

In a first time period T1', as shown in FIG. 6A, the reset signal Reset (the read control signal Sc) is at a low level, and other signals are at a high level. The reset signal Reset is at a low level, and the seventh transistor M7 and the eighth transistor M8 are turned on. The read control signal Sc is at a low level, and the second transistor M2 is turned on. A potential at the anode of the light-emitting element becomes the low level initial voltage Vinit, and the voltage at the second node N2 becomes the low level initial voltage Vinit. Thereby, the driving transistor Md is turned on, and the potential at the anode of the light-emitting element is further reduced to Vinit rapidly. A voltage difference Vc across the capacitor Cst is equal to Vdd-Vinit. At the same time, the second transistor M2 is turned on, so that a voltage value $V_{N1}$ at the first node N1 at this time is written into the read signal line RL, and is transmitted to a processing IC via the RL to analyze the voltage value $V_{N1}$ at the first node N1. Thereby, a sensing result of the sensing element Sen in a previous display period (i−1) is determined. The first time period T1' may be referred to as a "driving sub-circuit reset phase."

Figure 6B:
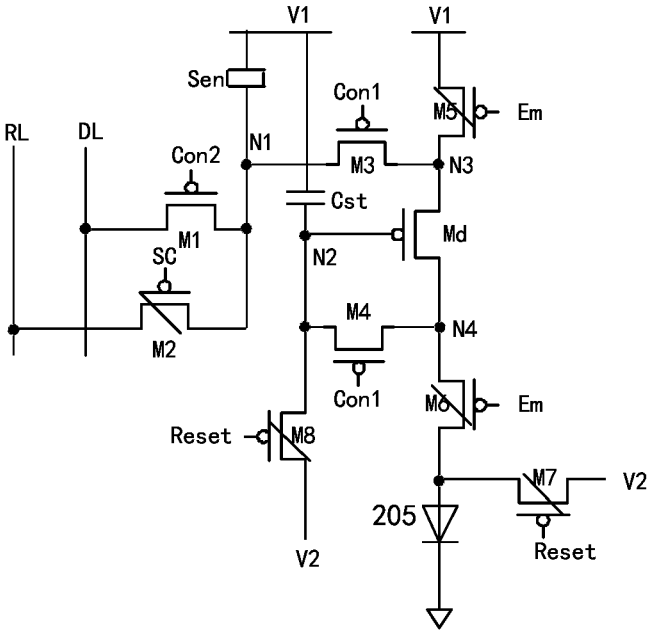
FIG. 6B illustrates a schematic diagram of a principle of the pixel circuit shown in FIG. 2B in a second time period.

In a second time period T2', as shown in FIG. 6B, the first control signal Con1 and the second control signal Con2 are at a low level, and other signals are at a high level. The third transistor M3 and the fourth transistor M4 are turned on, and the first transistor M1 is turned on. In the second time period T2', the second transistor M2, the fifth transistor M5, the sixth transistor M6, the seventh transistor M7, and the eighth transistor M8 are turned off. As in the example described with reference to FIG. 2A, the voltage value $V_{N2}$ at the second node N2 at this time is equal to Vg=Vdata+Vth, where Vg is a gate voltage of the driving transistor Md, and Vth is a threshold voltage of the driving transistor Md.

Figure 6C:
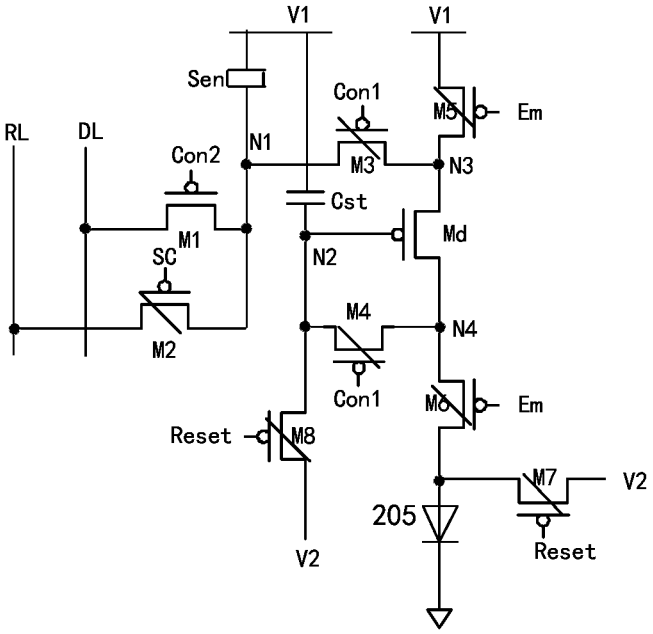
FIG. 6C illustrates a schematic diagram of a principle of the pixel circuit shown in FIG. 2B in a third time period.

In a third time period T3', as shown in FIG. 6C, the second control signal Con2 is at a low level, and other signals are at a high level. The second control signal Con2 is at a low level, and the first transistor M1 is turned on. At this time, the voltage value $V_{N1}$ at the first node N1 is equal to Vref, which is equivalent to resetting the sensing sub-circuit to provide a reference potential for the sensing result of the sensing element.

Figure 6D:
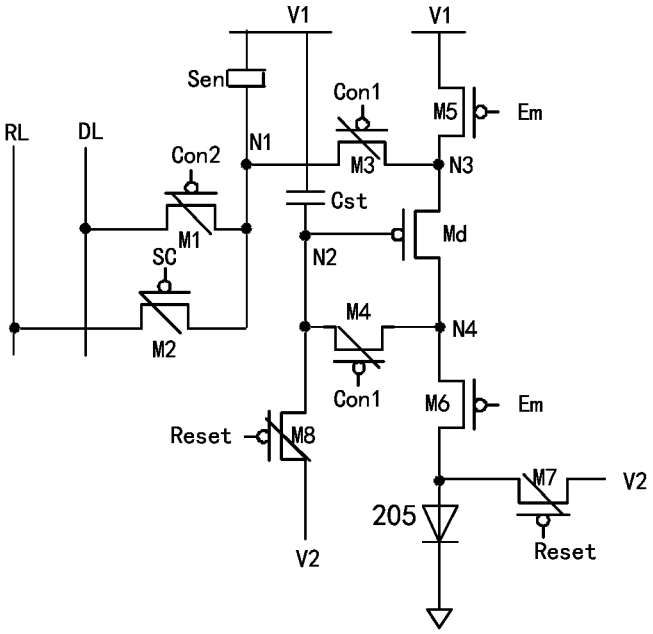
FIG. 6D illustrates a schematic diagram of a principle of the pixel circuit shown in FIG. 2B in a fourth time period.

In a fourth time period T4', as shown in FIG. 6D, the light-emitting control signal Em is at a low level, and other signals are at a high level. The fifth transistor M5 and the sixth transistor M6 are turned on, and the light-emitting element emits light. As in the example described with reference to FIG. 2A, driving current I flowing through the light-emitting element is:

$$I=K(V\text{data}-Vdd)^2.$$

Further, in the fourth time period T4', the potential $V_{N1}$ at the first node N1 is equal to Vsense+Vref, where Vsense indicates a value of an external input sensed by the sensing element Sen.

According to another embodiment of the present disclosure described above, the circuit control and the circuit structure may be simplified by disposing the second transistor M2 and inputting the reset signal Reset to the gate of the second transistor to use the reset signal Reset as the read control signal Sc.

It can be understood by those skilled in the art that in the driving method according to the embodiments of the present disclosure, there may further be buffering time periods between the first time period and the second time period, between the second time period and the third time period, and between the third time period and the fourth time period. In the buffering time periods, voltages of all signals are at, for example, a high level to turn off all the transistors. That is, in the buffering time periods, the pixel circuit does not operate, thereby avoiding timing disorder of the pixel circuit. This is because in practical applications, "high level" and "low level" are relatively high and low, and there may be a certain rising time and a certain falling time of a waveform. For example, in theory, the first control signal Con1 should be at a low level when the reset signal Reset is at a high level. However, if an absolute high level and an absolute low level cannot be achieved at this time, for example, when the reset signal Reset is at a low level, the first control signal Con1 is also at a low level, the timing disorder may occur. This can be avoided by inserting the buffering periods between the respective time periods.

Figure 7:
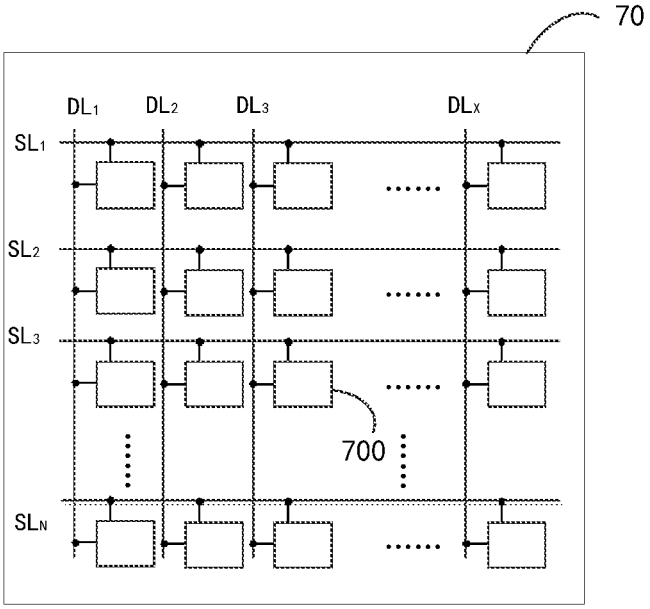
FIG. 7 illustrates a schematic block diagram of a display panel according to an embodiment of the present disclosure.

According to another aspect of the embodiments of the present disclosure, there is provided a display panel. FIG. 7 illustrates a schematic block diagram of a display panel 70 according to an embodiment of the present disclosure. As shown in FIG. 7, the display panel 70 may comprise a plurality of scanning signal lines $SL_1$ to $SL_N$; a plurality of data signal lines $DL_1$ to $DL_X$ disposed to intersect the plurality of scanning signal lines $SL_1$ to $SL_N$ in vertical and horizontal directions; and a plurality of pixel units 700 at intersections of the signal lines and the data signal lines, wherein at least one of the plurality of pixel units 700 is provided with the pixel circuit according to the embodiment of the present disclosure.

For example, at least one of the plurality of scanning signal lines is used as the read signal line RL.

It can be understood by those skilled in the art that there is no need to dispose the pixel circuit having a sensing element according to the embodiments of the present disclosure in each pixel unit of the display panel. The pixel circuit having a sensing element may be regionally arranged according to practical use, layout, and sensing accuracy. For example, the sensors may be arranged reasonably, to realize real feedback of screen information (uniformity of screen brightness) and accurately determine a brightness difference, so as to compensate for the screen brightness. The sensing element may sense a pressure, a brightness difference, touch of a finger, etc. A plurality of sensing elements for sensing a pressure, touch, brightness, and temperature, etc. may be disposed in the display panel in a mixed manner to enable the display panel to have various functions integrated therein.

Figure 8:
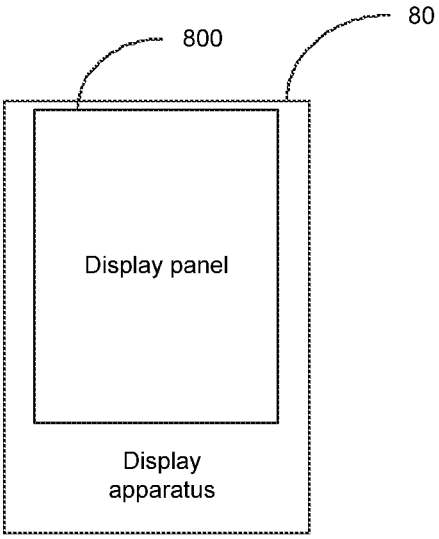
FIG. 8 illustrates a schematic block diagram of a display apparatus according to an embodiment of the present disclosure.

According to another aspect of the embodiments of the present disclosure, there is provided a display apparatus. FIG. 8 illustrates a schematic block diagram of a display apparatus according to an embodiment of the present disclosure. As shown in FIG. 8, the display apparatus 80 may comprise a display panel 800 according to an embodiment of the present disclosure. The display apparatus 80 according to the embodiment of the present disclosure may be any product or component having a display function such as an electronic paper, a mobile phone, a tablet computer, a television, a display, a notebook computer, a digital photo frame, a navigator, etc.

The specific embodiments described above further illustrate the purposes, technical solutions and beneficial effects of the embodiments of the present disclosure. It is to be understood that the foregoing description is merely specific embodiments of the present disclosure, and is not intended to limit the present disclosure. Any modifications, equivalent substitutions, improvements etc. made within the spirit and principle of the present disclosure shall be included within the protection scope of the present disclosure.

I claim:

1. A pixel circuit, comprising:

a light-emitting element;

a driving sub-circuit having a light-emitting control terminal for receiving a light-emitting control signal and an output terminal connected to a first terminal of the light-emitting element, wherein the driving sub-circuit is configured to provide current for causing the light-emitting element to emit light to the light-emitting element under control of a light-emitting control signal;

a reset sub-circuit having a reset signal terminal for receiving a reset signal, wherein the reset sub-circuit is connected to the driving sub-circuit and the first terminal of the light-emitting element, and is configured to reset the driving sub-circuit and the first terminal of the light-emitting element under control of the reset signal;

a data writing sub-circuit having a first control signal terminal for receiving a first control signal, wherein the data writing sub-circuit is connected to the driving sub-circuit and the reset sub-circuit, and is configured to write a data voltage into the driving sub-circuit under control of a first control signal; and a sensing sub-circuit having a first signal terminal connected to a data signal line, a second signal terminal connected to a read signal line, and a second control signal terminal for receiving a second control signal, wherein the sensing sub-circuit is connected to the data writing sub-circuit, wherein the sensing sub-circuit is configured to: receive a data signal via the first signal terminal, and transmit the data signal to the data writing sub-circuit under control of the second control signal; and sense an external input, and read the sensed external input into the read signal line under control of a read control signal, and wherein the sensing sub-circuit comprises:

a sensing element, wherein a first terminal of the sensing element is connected to a first voltage terminal, and a second terminal of the sensing element is connected to a first node; and a first transistor, wherein a gate of the first transistor is connected to the second control signal terminal, a first electrode of the first transistor is connected to the data signal line, and a second electrode of the first transistor is connected to the first node, wherein the first node is directly connected to the read signal line.

2. The pixel circuit according to claim 1, wherein the sensing sub-circuit further comprises a read control signal terminal for receiving the read control signal.

3. The pixel circuit according to claim 2, wherein the sensing sub-circuit comprises:

a sensing element, wherein a first terminal of the sensing element is connected to the first voltage terminal, and a second terminal of the sensing element is connected to the first node;

a first transistor, wherein a gate of the first transistor is connected to the second control signal terminal, a first electrode of the first transistor is connected to the data signal line, and a second electrode of the first transistor is connected to the first node; and a second transistor, wherein a gate of the second transistor is connected to the read control signal terminal, a first electrode of the second transistor is connected to the read signal line, and a second electrode of the second transistor is connected to the first node.

4. The pixel circuit according to claim 1, wherein the data writing sub-circuit comprises:

a third transistor, wherein a gate of the third transistor is connected to the first control signal terminal, a first electrode of the third transistor is connected to a first node, and a second electrode of the third transistor is connected to the driving sub-circuit; and a fourth transistor, wherein a gate of the fourth transistor is connected to the first control signal terminal, a first electrode of the fourth transistor is connected to a second node, and a second electrode of the fourth transistor is connected to the driving sub-circuit.

5. The pixel circuit according to claim 4, wherein the driving sub-circuit comprises a fifth transistor, a storage capacitor, a driving transistor, and a sixth transistor, wherein a gate of the fifth transistor is connected to a light-emitting control signal terminal, a first electrode of the fifth transistor is connected to a first voltage terminal, and a second electrode of the fifth transistor is connected to a source of the driving transistor;

a first terminal of the storage capacitor is connected to the first voltage terminal, and a second terminal of the storage capacitor is connected to a gate of the driving transistor;

a drain of the driving transistor is connected to a first electrode of the sixth transistor; and a gate of the sixth transistor is connected to the light-emitting control signal terminal, and a second electrode of the sixth transistor is connected to the first terminal of the light-emitting element.

6. The pixel circuit according to claim 4, wherein the reset sub-circuit comprises a seventh transistor and an eighth transistor, wherein a gate of the seventh transistor is connected to the reset signal terminal, a first electrode of the seventh transistor is connected to a second voltage terminal, and a second electrode of the seventh transistor is connected to the first electrode of the fourth transistor; and a gate of the eighth transistor is connected to the reset signal terminal, a first electrode of the eighth transistor is connected to the second voltage terminal, and a second electrode of the eighth transistor is connected to the first terminal of the light-emitting element; and a second terminal of the light-emitting element is grounded.

7. The pixel circuit according to claim 6, wherein the sensing element comprises at least one of a pressure sensor, a photosensor, and a temperature sensor.

8. A display panel, comprising:

a plurality of scanning signal lines;

a plurality of data signal lines disposed to intersect the plurality of scanning signal lines; and a plurality of pixel units disposed at intersections of the data signal lines and the scanning signal lines, wherein at least one of the plurality of pixel units comprises the pixel circuit according to claim 1.

9. The display panel according to claim 8, wherein at least one of the plurality of scanning signal lines is used as the read signal line.

10. A display apparatus, comprising the display panel according to claim 8.

11. A method for driving the pixel circuit according to claim 1, comprising:

in a first time period, resetting the driving sub-circuit;

in a second time period, writing, by the writing sub-circuit, a data voltage into the driving sub-circuit;

in a third time period, resetting the sensing sub-circuit; and in a fourth time period, sensing, by the sensing sub-circuit, an external input.

12. The method according to claim 11, wherein the sensing sub-circuit reads a sensing voltage sensed by the sensing element into the read signal line in at least one of the first time period and the fourth time period under control of the read control signal.

13. The method according to claim 11, wherein in the first time period, the first transistor is turned off, and a voltage at the first node is transmitted to the read signal line under control of the read control signal;

in the second time period, the voltage on the data signal line is a data voltage, the first transistor is turned on, and the first node is set to the data voltage;

in the third time period, the voltage on the data signal line is a reference voltage, the first transistor is turned on, and the first node is set to the reference voltage; and in the fourth time period, the first transistor is turned off, and the first node is set to a sum of the reference voltage and the sensing voltage.

14. The method according to claim 11, wherein the reset signal is used as the read control signal.

15. The pixel circuit according to claim 3, wherein the data writing sub-circuit comprises:

a third transistor, wherein a gate of the third transistor is connected to the first control signal terminal, a first electrode of the third transistor is connected to a first node, and a second electrode of the third transistor is connected to the driving sub-circuit; and a fourth transistor, wherein a gate of the fourth transistor is connected to the first control signal terminal, a first electrode of the fourth transistor is connected to a second node, and a second electrode of the fourth transistor is connected to the driving sub-circuit.

16. A method for driving the pixel circuit according to claim 3, comprising:

in a first time period, resetting the driving sub-circuit;

in a second time period, writing, by the writing sub-circuit, a data voltage into the driving sub-circuit;

in a third time period, resetting the sensing sub-circuit; and in a fourth time period, sensing, by the sensing sub-circuit, an external input.

* * * * *